US011933038B2

(12) United States Patent
Cost et al.

(10) Patent No.: US 11,933,038 B2
(45) Date of Patent: Mar. 19, 2024

(54) FINISHING BRACKET

(71) Applicant: BRACKET BROTHERS LLC, Pompano Beach, FL (US)

(72) Inventors: Kevin Cost, Coconut Creek, FL (US); Dale Beswick, Southwest Ranches, FL (US)

(73) Assignee: Beyond The Grain, LLC, Southwest Ranches, FL (US)

( * ) Notice: Subject to any disclaimer, the term of this patent is extended or adjusted under 35 U.S.C. 154(b) by 72 days.

(21) Appl. No.: 17/818,756

(22) Filed: Aug. 10, 2022

(65) Prior Publication Data

US 2024/0052625 A1 Feb. 15, 2024

(51) Int. Cl.
*E04B 1/38* (2006.01)

(52) U.S. Cl.
CPC ..... *E04B 1/388* (2023.08); *E04B 2001/389* (2023.08)

(58) Field of Classification Search
CPC ..... E04B 1/388; E04B 2001/389
USPC ..... 248/152, 174, 247, 248, 300, 301, 235, 248/240.4, 242, 250, 287
See application file for complete search history.

(56) References Cited

U.S. PATENT DOCUMENTS 4,463,510 A * 8/1984 Windish ..... A47F 5/0823 40/124.4
4,671,002 A * 6/1987 Fast ..... A47F 5/0869 40/655
4,796,403 A * 1/1989 Fulton ..... E04D 3/362 52/545
5,088,606 A * 2/1992 Boas ..... A47F 5/0869 248/224.7
5,325,616 A * 7/1994 Valiulis ..... A47F 5/0869 40/642.01
5,720,571 A * 2/1998 Frobosilo ..... E04B 2/96 403/231
6,349,911 B1 * 2/2002 Feldpausch ..... A47B 57/34 248/250
6,375,137 B1 * 4/2002 McQuade ..... A47G 7/045 248/301
6,904,730 B2 * 6/2005 Mitchell ..... E04D 3/363 52/545
7,478,508 B2 * 1/2009 Peterson ..... E04B 2/96 248/300
7,878,473 B1 * 2/2011 Oh ..... F16M 11/046 248/490
8,272,183 B2 * 9/2012 Dodge ..... E04D 15/04 52/712
8,979,052 B2 * 3/2015 Uota ..... E04F 13/0801 403/381

(Continued)

*Primary Examiner* — Eret C McNichols
(74) *Attorney, Agent, or Firm* — McHale & Slavin, P.A.

(57) ABSTRACT

An adjustable finishing bracket assembly for use in concealing retractable shades, screens, hangers and the like. The assembly employs an L-bracket having slots for horizontal positioning and threaded apertures for securing to a hook bracket. The hook bracket has adjustment slots for securing to the L-bracket and a U-shaped distal end. The hook bracket is securable to the L-shaped bracket and a hanger bracket. A level bolt is connected to the L-shaped bracket. The adjustable finishing bracket provides horizontal, vertical and angular positioning of the wood plank to assure the wood plank is properly aligned and provides an easily removable wood plank for access to the retractable mechanisms.

10 Claims, 4 Drawing Sheets

(56) References Cited

U.S. PATENT DOCUMENTS

| | | | | |
|---|---|---|---|---|
| 2005/0017142 | A1* | 1/2005 | Ogden | E04D 13/1625 248/300 |
| 2008/0191108 | A1* | 8/2008 | Hsu | A47J 37/041 248/207 |
| 2009/0040692 | A1* | 2/2009 | Barringer | H05K 7/1495 361/825 |
| 2014/0083045 | A1* | 3/2014 | Dodge, Sr. | E04F 13/0842 52/702 |

* cited by examiner

FINISHING BRACKET

FIELD OF THE INVENTION

The present invention relates to the field of patio construction and, in particular, to a finishing bracket for use in concealing access areas to patio rolling shades, rolling screens, rolling shutters, or other patio ceiling mounted devices.

BACKGROUND OF THE INVENTION

Patios define a space typically used to extend the usable living area of a property. A conventional patio includes a roof for protection from the sun and rain, a floor, and window openings therebetween which allow the occupants to enjoy the outdoors. The patio can be an extension to a residential property wherein shades allow the patio to be used in direct sunlight, or screens for use in keeping insects out of the patio area. A finished patio may be used for entertaining. Commercial properties may use a patio to provide outdoor restaurant services.

For example, a patio may be usable during certain daylight hours when sunlight passes directly through the window opening unless shades are deployed. In another example, retractable screens may be employed if the patio is prone to mosquitoes or no-see-ums during certain hours. Yet another example is the use of retractable shutters for security or hurricane protection. In this manner, hurricane screens may be employed.

In each example, the type of window treatment employed is subject to personal preference. The window treatments can be manufactured in all shapes and sizes, many of which employ a retractable mechanism that requires a storage area and deployment mechanisms. For ease of description, a retractable shade assembly is primarily used in this disclosure as an embodiment with the understanding that the instant invention can also be used with retractable screens, retractable shutters, or for concealing most anything that may secure to a patio ceiling and otherwise distract from the patio area.

Upscale patios typically include a ceiling finished with wood planks. For instance, a popular option is the use of cypress wood assembled using tongue and groove construction. If the window treatment includes a retractable shade, the shade storage area and deployment mechanism can be an unsightly addition to the finished ceiling. The result is a large unsightly box that detracts from the otherwise finished ceiling. A concealment structure can be placed around the window treatment storage box and deployment motor, but known concealment structures inhibit access to the window treatment equipment. By inhibiting access, the probably of routine maintenance is lessen, leading to early equipment failure.

What is needed in the industry is a finishing bracket for use with a concealment structure to allow ease of access to retraction and deployment mechanisms.

SUMMARY OF THE INVENTION

An adjustable finishing bracket assembly for securing a wood plank to a concealment structure for use in concealing retractable shades, screens, shutters and the like. The assembly includes an L-bracket defined by a horizontal arm with slots and a vertical arm with threaded apertures. The horizontal arm is attached to the top of a concealment plank. A hook bracket has a proximal end spaced apart from a U-shaped distal end with adjustment slots positioned to align with two of the L-bracket threaded apertures. The hook bracket is securable to the vertical arm of said L-shaped bracket. A hanger bracket is constructed and arranged to engage the hook bracket; the hanger bracket is secureable to a wall structure and a level bolt is connected to the vertical arm. The adjustable finishing bracket provides horizontal, vertical and angular positioning of the wood plank to assure the wood plank is properly aligned, allowing the plank to otherwise appear secured to the finished ceiling. The instant invention provides an easily removable wood plank for access to the retractable mechanisms.

Accordingly, it is an objective of the instant invention to provide a finishing bracket that is fully adjustable and allows for concealment of roller shades, roller screens, roller shutters, and the like devices that may be attached to a patio ceiling.

Still another objective of the instant invention is to provide a finishing bracket that allows centering and alignment of an access panel providing horizontal, vertical and angular adjustment to assure the access panel conforms to the finished patio ceiling.

Yet another objective of the invention is to provide a finishing bracket wherein tools are unnecessary to remove or replace the installed access panel.

Still another objective of the invention is to provide a finishing bracket that secures to all hardwoods including cypress, Ipe, plywood, or any other material desired for concealment.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
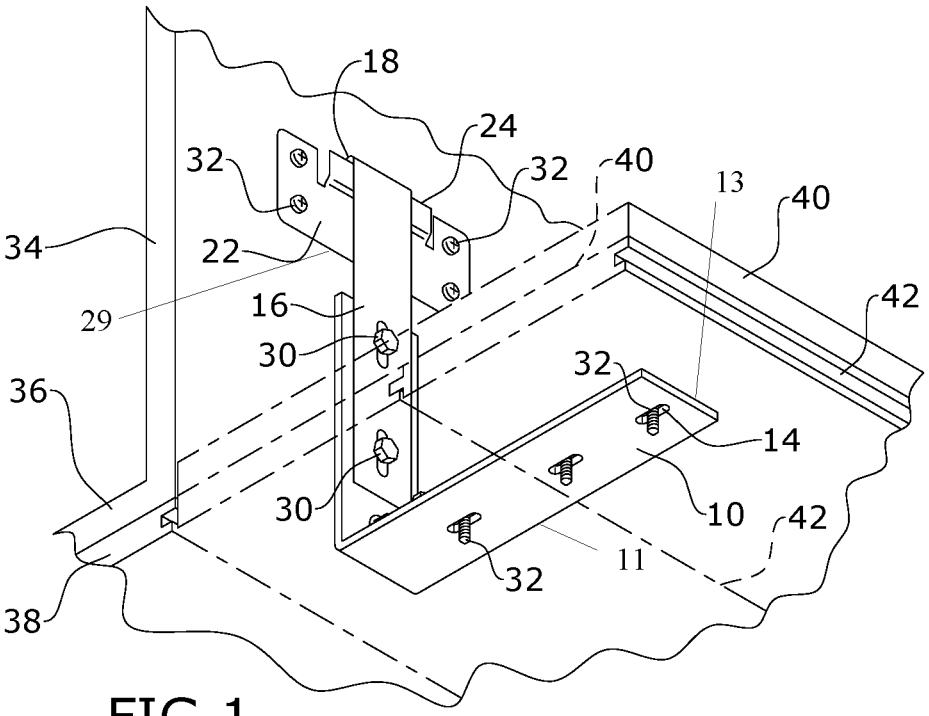
FIG. 1 is a lower perspective view of the adjustable mounting bracket secured to a shade pocket.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring to the Figures, set forth is a finishing bracket assembly for securing a wood plank to a concealment structure comprising an L-bracket 10 defined by a horizontal arm 11 having a first end 13 spaced apart from a common edge 15 by a first length L1 of about 6.25 inches with three centrally disposed adjustment slots 14 that are about 0.625 inches long, and a vertical arm 17 having a second end 19 spaced apart from the common edge 15 by a second length L2 of about 4.5 inches with three centrally disposed threaded apertures 12. The horizontal arm 11 is securable to an upper surface 40 of a finished wood plank 42 by placement of screw fasteners 32 into each of the adjustment slots 14, providing adjustable horizontal positioning.

A hook bracket 16 having a proximal end 21 spaced apart from a U-shaped distal end 23 by a third length L3 of about 4.75 inches with two centrally disposed adjustment slots 20 positioned to align with two of said L-bracket 10 threaded apertures 12. The hook-shaped bracket 16 is securable to the vertical arm 17 of L-shaped bracket 10 by fasteners 30 placed through the adjustment slots 20 that is about 1 inch long, to provide adjustable vertical positioning.

A hanger bracket 22 is defined by a lower edge 29, opposing side edges 31, 33, and an upper edge 24. The hanger bracket 22 is constructed and arranged to engage the U-shaped distal end or hook 18 of the hook bracket 16. The hanger bracket 22 is secureable to a fixed wall using a plurality of threaded screw fasteners 32. The hanger bracket 22 is secured to the ceiling structure 34 mounted over the shade pocket 36 and the finished ceiling 38.

A level bolt 25 is operatively associated with one of the centrally disposed threaded apertures 12 and with a level foot 26 provides angular positioning of the plank 42. A lock nut 28 is used to secure the level bolt 25 in a fixed position once adjusted.

In operation, the horizontal positioning of the wood plank 42 is adjusted upon securing the horizontal arm 11, vertical positioning is provided by adjusting the vertical arm 17, and angular positioning is provided by adjusting the level bolt 25. The wood plank 42 can be removed from the assembly by detaching the hook bracket 16 from the hanger bracket 22, wherein the hook 18 is removed from the upper edge 24 by lifting the hook 18 over the upper edge 24. In a preferred embodiment, the upper edge 24 is formed inward of the side edge 31, 33, wherein the hanger bracket 22 may be attached to a vertical shade pocket 34. In the preferred embodiment, the finishing ceiling 38 may include a tongue and groove configuration as illustrated, with tongue absent from the shade ceiling for ease of attachment and removal of the hook bracket 16 from the hanger bracket 22.

Figure 2:
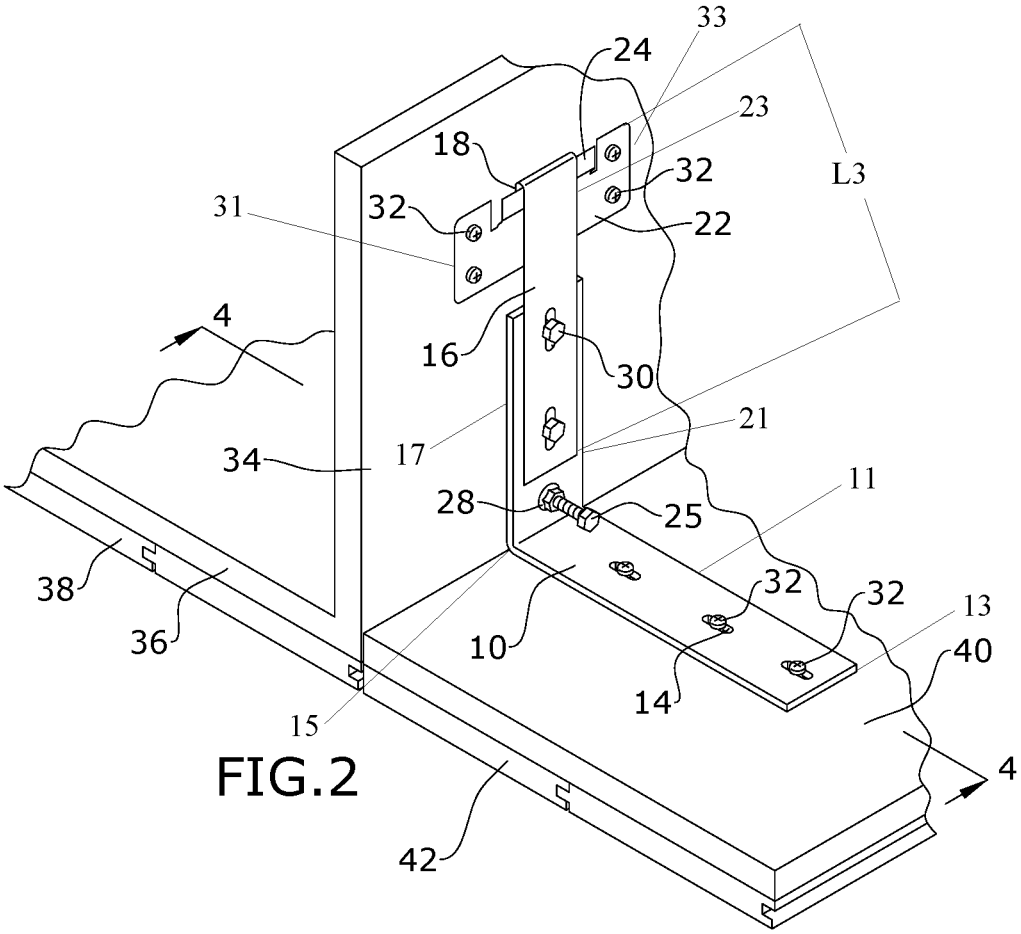
FIG. 2 is an upper perspective view of FIG. 1.
Figure 3:
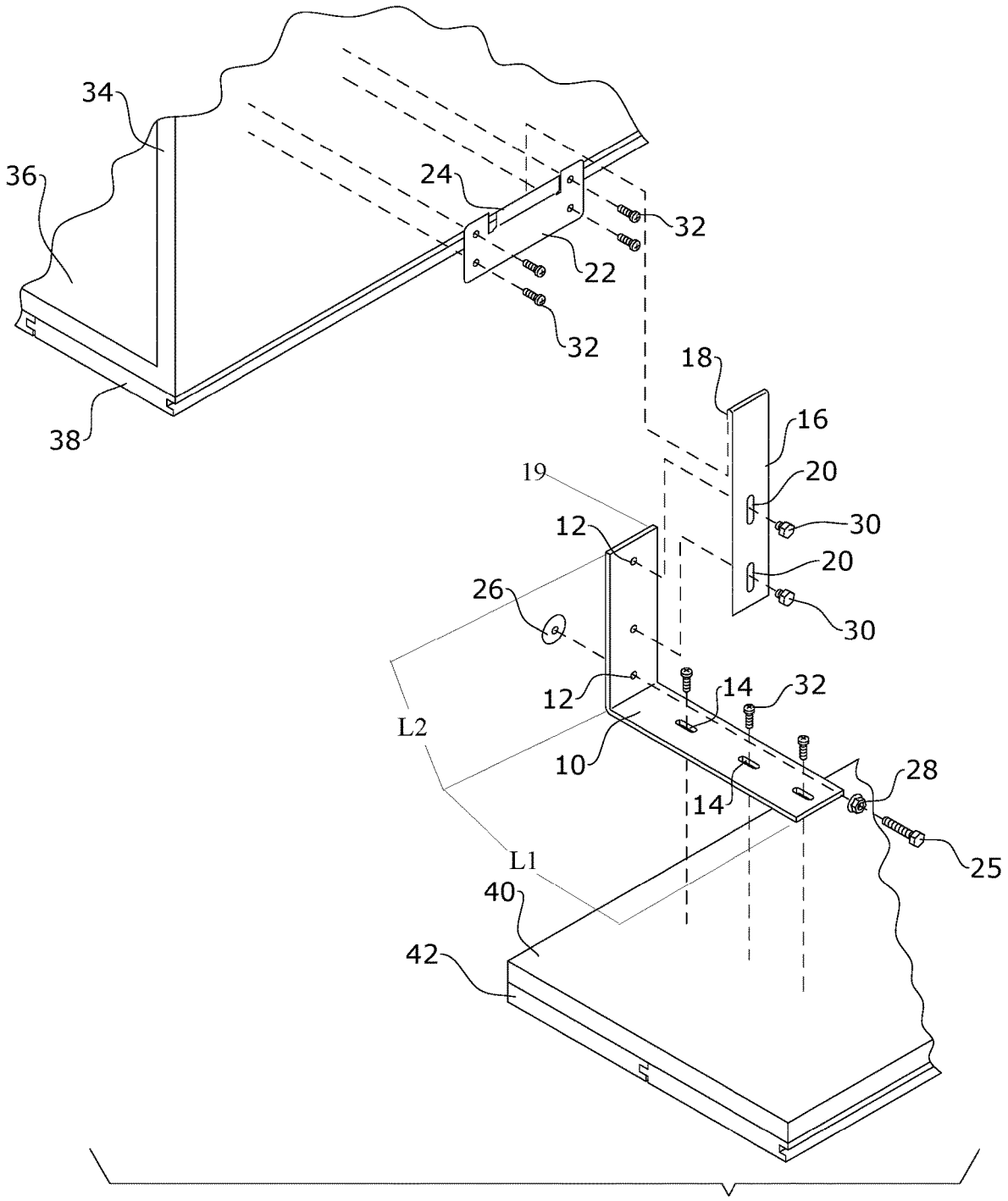
FIG. 3 is an upper perspective exploded view.

FIG. 1 is a lower perspective view of the adjustable mounting bracket secured to a shade pocket in use; FIG. 2 being a top perspective view thereof. The Figures depict the assembly of the finishing ceiling 38 comprising an L-bracket 10, a hook bracket 16 and a hanger bracket 22. FIG. 3 provides an exploded view thereof; the level bolt 25 with locknut 28 engaging the vertical arm 17 with a level foot 26 to provide angular positioning of the plank 42. The lock nut 28 secures the level bolt 25 in a fixed position.

Figure 4:
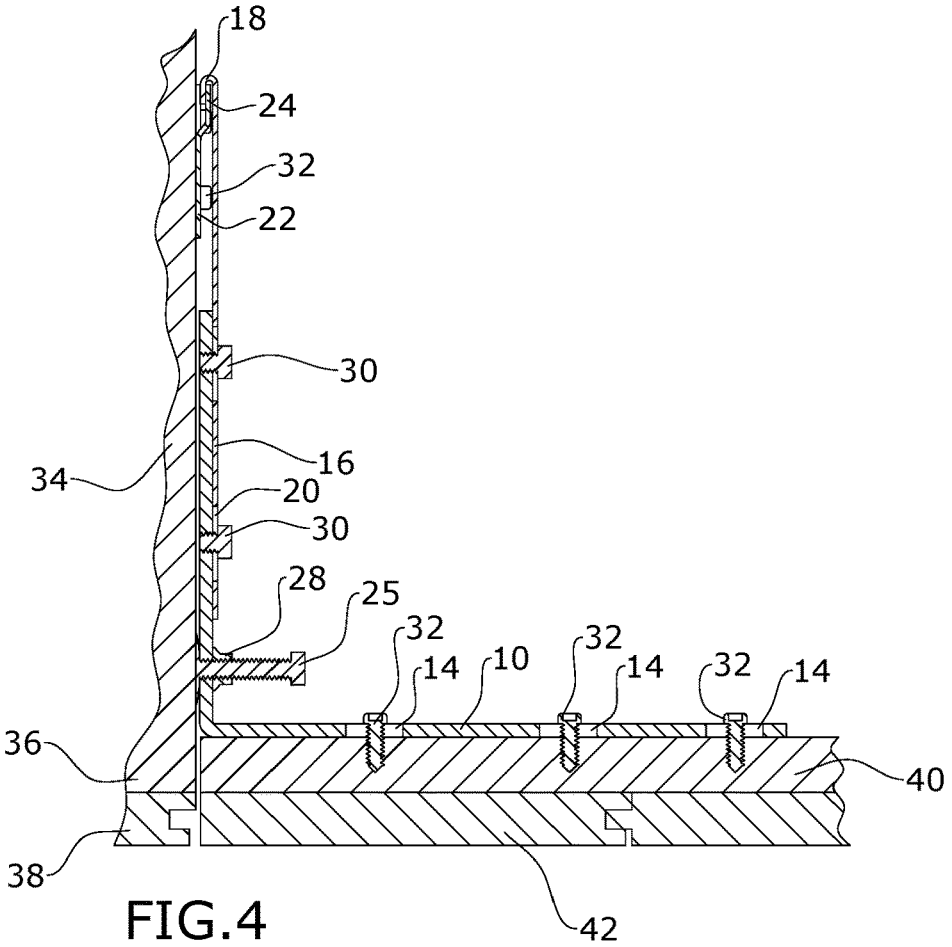
FIG. 4 is cross-sectional side view of the adjustable mounting bracket.
Figure 5:
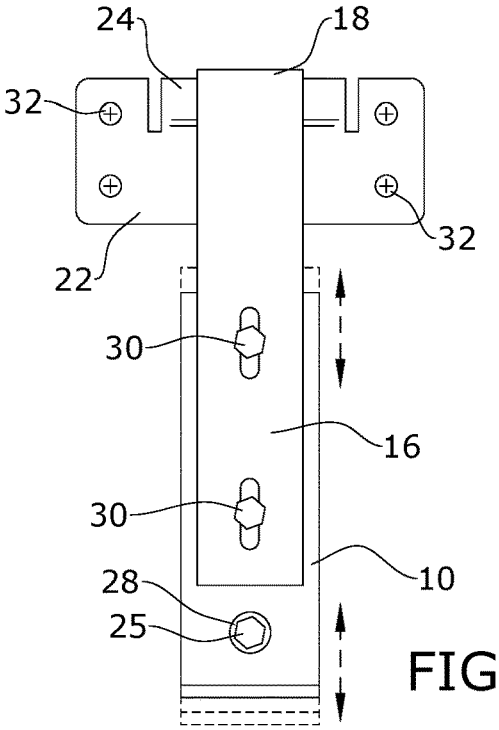
FIG. 5 is a plane front view.
Figure 6:
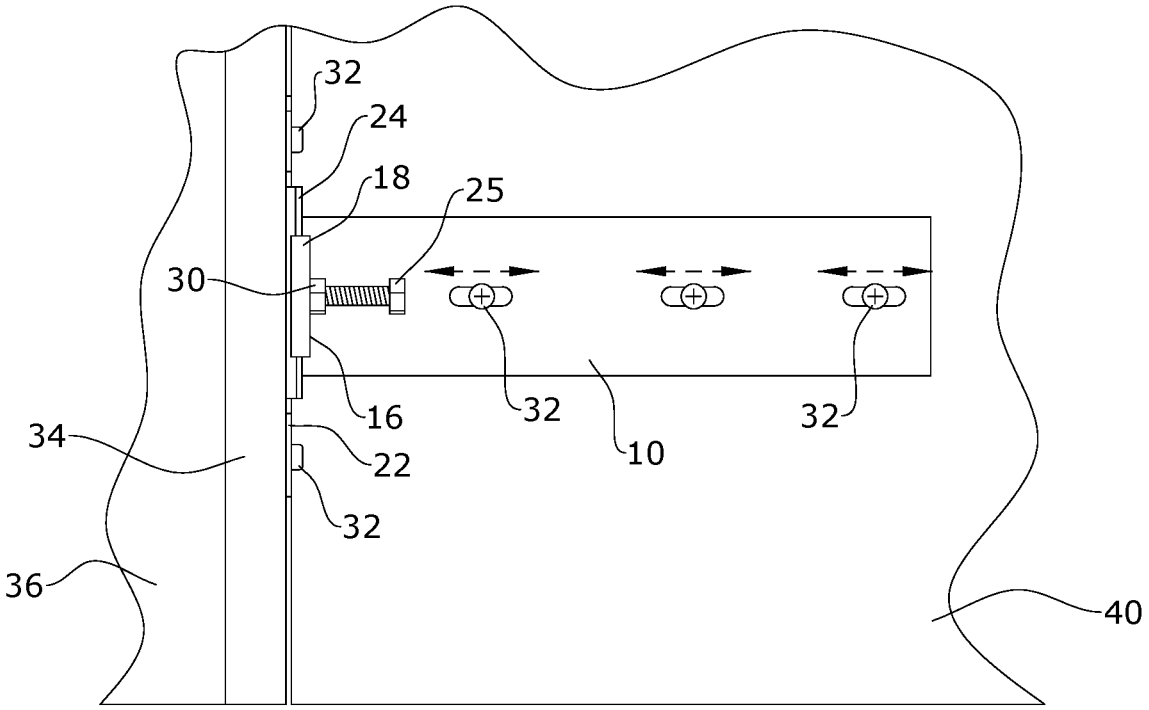
FIG. 6 is a plane top view.
Figure 7:
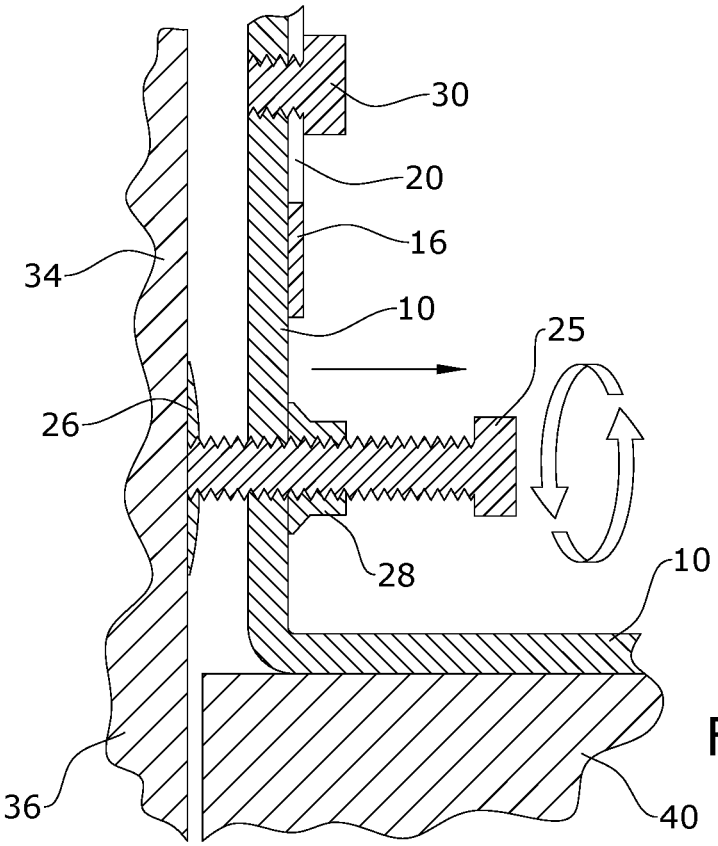
FIG. 7 is a cross-sectional side view of the adjustment bolt.

FIG. 4 is cross-sectional side view of the L-shaped bracket 10 depicting the depth of the screws 32 inserted into the upper surface of the plank 40. The hook bracket 16 is illustrated attached to the L-bracket 10 using bracket bolts 30. The hook 18 is placed over the hanger bracket upper edge 24. FIG. 5 depicts the adjustability of the hook bracket 16 relative to the L-shaped bracket 10 by adjustment of the bracket bolts 30. FIG. 6 is a top view of the L-shaped bracket 10 depicting the adjustability to the plank 40 with screw fasteners 32. FIG. 7 is a cross-sectional view of the level bolt 25 for engaging the L-shaped bracket 10, wherein rotation of the level bolt 25 moves the bracket 10 in relation to the ceiling shade pocket 34. The level foot 26 distributes the pressure point against the shade pocket 34. Once adjusted, the level bolt 25 is secured in position by a lock nut 28. The level bolt 25 provides angular positioning of the plank 42. Once adjusted, the finishing bracket assembly allows ease of plank 40 removal for access to any underlying roller shade, roller screen, roller shutter, or the like devices that may be installed with the roof of the patio ceiling.

The term "coupled" is defined as connected, although not necessarily directly, and not necessarily mechanically. The use of the word "a" or "an" when used in conjunction with the term "comprising" in the claims and/or the specification may mean "one," but it is also consistent with the meaning of "one or more" or "at least one." The term "about" means, in general, the stated value plus or minus 5%. The use of the term "or" in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any figure included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An adjustable finishing bracket for securing a wood plank to a concealment structure, said finishing bracket comprising;

an L-bracket defined by a horizontal arm having a first end spaced apart from a common edge by a first length L1 with three centrally disposed adjustment slots, and a vertical arm having a second end spaced apart from the common edge by a second length L2 with three centrally disposed threaded apertures, wherein said horizontal arm is securable to an upper surface of a wood plank by placement of screw fasteners into each said adjustment slot, providing adjustable horizontal positioning;

a hook bracket having a proximal end spaced apart from a U-shaped distal end by a third length L3 with two centrally disposed adjustment slots positioned to align with two of said L-bracket threaded apertures, said hook-shaped bracket securable to said vertical arm of said L-shaped bracket by a first and second fastener placed through said adjustment slots, providing adjustable vertical positioning;

a hanger bracket defined by a lower edge, opposing side edges, and an upper edge constructed and arranged to engage said U-shaped distal end of said hook bracket, said hanger bracket secureable to a fixed wall using a plurality of threaded screw fasteners; and a level bolt operatively connected to one of said centrally disposed threaded apertures, wherein said level bolt providing adjustable angular positioning;

wherein horizontal positioning of the wood plank is adjusted upon securing said horizontal arm, vertical positioning is provided by adjusting said vertical arm, and angular positioning is provided by said level bolt; wherein said wood plank can be removed from said assembly by detaching said hanger bracket from said hook bracket.

2. The adjustable finishing bracket according to claim 1 wherein said level bolt includes a level foot.

3. The adjustable finishing bracket according to claim 1 wherein said level bolt includes a lock nut.

4. The adjustable finishing bracket according to claim 1 wherein hanger bracket is spaced inwardly from said opposing edges.

5. The adjustable finishing bracket according to claim 1 wherein said L-bracket, hook bracket, and hanger bracket are constructed from stainless steel.

6. The adjustable finishing bracket according to claim 1 wherein said L-bracket horizontal arm L1 is about 6.25 inches long.

7. The adjustable finishing bracket according to claim 1 wherein said L-bracket vertical arm L2 is about 4.5 inches long.

8. The adjustable finishing bracket according to claim 1 wherein said hook bracket L3 is about 4.75 inches long.

9. The adjustable finishing bracket according to claim 1 wherein said horizontal arm adjustment slots are about 0.625 inches long.

10. The adjustable finishing bracket according to claim 1 wherein said vertical arm adjustment slots are about 1 inch long.

* * * * *